US006088881A

United States Patent [19]

Van Doorn et al.

[11] Patent Number: 6,088,881

[45] Date of Patent: Jul. 18, 2000

[54] METHOD AND APPARATUS FOR SEPARATING FOREIGN MATTER FROM FIBROUS MATERIAL

[75] Inventors: Donald William Van Doorn, Columbus; James Brown Hawkins, Fortson, both of Ga.

[73] Assignee: Lummus Corporation, Columbus, Ga.

[21] Appl. No.: 09/162,563

[22] Filed: Sep. 29, 1998

[51] Int. Cl.[7] ..... D01B 1/04

[52] U.S. Cl. ..... 19/202; 19/39; 19/64.5

[58] Field of Search ..... 19/40, 41, 65 A, 19/200, 202, 203, 204, 205, 39, 42, 48 R, 64.5

[56] References Cited

U.S. PATENT DOCUMENTS

| | | | |
|---|---|---|---|
| Re. 26,649 | 8/1969 | Reddick . | |
| 2,948,022 | 8/1960 | Day | 19/203 |
| 3,470,588 | 10/1969 | Just | 19/202 |
| 4,407,047 | 10/1983 | Van Doorn et al. | 19/202 |
| 4,458,381 | 7/1984 | Van Doorn et al. | 19/202 |
| 5,173,994 | 12/1992 | Gillum et al. | 19/200 |
| 5,295,283 | 3/1994 | Gillum et al. | 19/200 |

*Primary Examiner*—Michael A. Neas
*Assistant Examiner*—Gary L. Welch
*Attorney, Agent, or Firm*—Robert J. Veal; Veal & Asociates, LLC

[57] ABSTRACT

An apparatus for separating foreign matter from fiber tufts includes an air duct in which fiber tufts are pneumatically conveyed into the system via a high speed air stream. The air duct provides an air stream that conveys the fiber tufts with trash on to a revolving cleaning cylinder having teeth to engage the fiber tufts at a velocity that is sufficient to prevent agglomeration of the fiber tufts on a cylinder. The fiber tufts and trash thereby engage a separating means without agglomeration of the fiber tufts. The fiber tufts and trash further engage a streamer plate and grid bars to separate the trash from the fiber tufts such that the clean fiber tufts are distributed to a lint flue. The apparatus may further include a perforated cylinder in close proximity with the revolving cleaning cylinder that allows air to flow there-through, but that prevents penetration of the perforated cylinder surface by the desired fiber tufts. The use of the perforated cylinder provides an efficient means to cause the fiber tufts to engage the revolving cleaning cylinder without agglomeration to remove the undesired trash and deliver the desirable fiber tufts into a battery condenser.

16 Claims, 3 Drawing Sheets

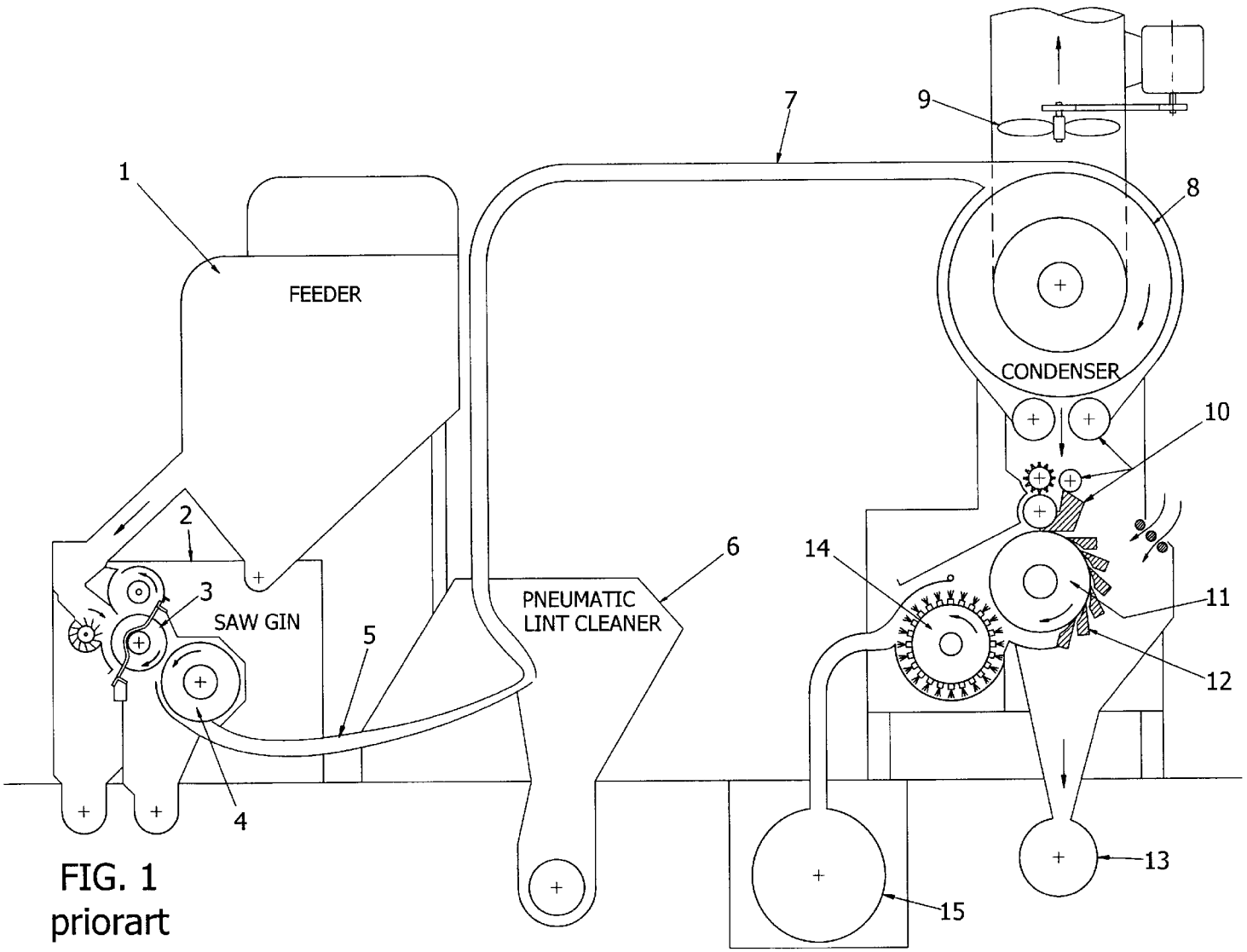
FIG. 1
priorart

METHOD AND APPARATUS FOR SEPARATING FOREIGN MATTER FROM FIBROUS MATERIAL

FIELD OF THE INVENTION

The present invention relates to the field of separating impurities from fibrous material such as cotton. More particularly, the invention relates to a method and apparatus following a cotton gin or other device that delivers the fiber in small tufts commingled in an air stream with foreign matter from which the fiber is to be separated.

BACKGROUND OF THE INVENTION

In the textile arts dealing with natural fibers, both at the cotton gin and in the textile mill opening rooms and cotton card licker-in sections, revolving cylinders with surfaces covered with fine, fang-type teeth pluck the fibrous material from a lap or batt of the material which is fed onto the toothed surface of the cylinder by various feed mechanisms. In these conventional systems, the foreign matter is of necessity imbedded in the batt or blanket of the fibrous material, thus, the fang-type teeth of the revolving cylinder must plow through the batt to pluck the fibers from the batt, and in so doing, tend to break up the foreign matter and imbed it in the fiber tufts making separation more difficult. While many of these textile cleaning processes must inherently form the fibrous material into a lap or batt to feed the material onto the fang toothed cylinder, there are some situations in which the method and apparatus of the present invention can avoid the agglomeration of the fibers which entraps the foreign matter between the tufts. In these situations the present invention enhances the foreign matter separation and avoids the breaking up of the foreign matter into finer particles which makes it more difficult to separate from the fibrous material.

One especially propitious situation exists directly following the gin stands in cotton gins. The predominant method of ginning worldwide is the saw gin. It is estimated that the gin saws pull the fibers from a seed in somewhere between ten and thirty fiber tufts. Each tuft then has hundreds of fibers and the trash is located only on the outside of the tufts, and at this point not intimately entangled in the fibers.

The other method of ginning cotton is referred to as the roller gin. In roller ginning, practically all the fibers are stripped from the seed in one large tuft on which the trash is even less entangled on the outer surfaces of the large tufts. In both saw ginning or roller ginning, the trash and fibers as they leave the ginning machine are spaced apart in the most desirable condition for easy separation.

Experiments conducted at the United States Department of Agriculture Ginning Laboratory at Mesilla Park, N. Mex., developed a system of primarily mechanically transferring the tufts of cotton fibers and the commingled trash directly from the doffing brush of the ginning machine to the toothed revolving cylinder of the fiber cleaner. This cylinder is commonly referred to as the lint cleaner saw cylinder. This system of mechanically transferring the lint fibers directly from the doffing brush cylinder of the ginning machine to the lint cleaner saw cylinder is covered in U.S. Pat. Nos. 5,414,900, 5,295,283, and 5,173,994.

Experiences have shown, however, that the apparatus and method covered by these patents have certain shortcomings that our invention overcomes and in addition, our invention results in further improvements in the- cleaning process. The primary shortcoming of the above U.S. patents is that the mechanical transfer of the fibers from the upstream saws to the downstream fiber cleaning saws with doffing brush cylinders cannot be accomplished without some air flow and the U.S. patents attempt to minimize this air flow with the result that the fiber transfer from the doffing brushes to the fiber cleaning saw cylinders is incomplete, thus allowing a certain amount of fiber flow beyond the doffing points. As shown in FIG. 1 of the above U.S. patents, the peripheries of the doffing brush cylinders 2 and 4 are spaced away from the tips of the saw teeth on cleaning cylinders 3 and 5 in an attempt to allow the necessary minimal amount of air to flow past the pinch points as illustrated at 3 on FIG. 1. This narrow space at the pinch points of less than 15 millimeters in practice both greatly reduces the desirable air flow and the efficiency of the fiber transfer from the doffing cylinders to the toothed cleaning cylinders. In practice it was also found that the gin saw cylinders in FIG. 1 are not cleanly doffed due to this reduced air flow around the doffing brush. Also, as described in the U.S. patents, air control bars 11, 17 and 24 must be employed to prevent the recirculation of the incompletely doffed fibers around the doffing brushes because the doffing brushes as at pinch point 3, are spaced away from the tips of the toothed cleaning cylinders to allow the minimum required amount of air to flow there between. As will later be seen, the apparatus and method of our invention overcome these shortcomings.

Referring again to the above U.S. patents drawing FIG. 1, it will be noted that the air laden with dust flows from the gin saws completely through the machine avoiding the cleaning bars 13 and 21 and exits through duct 25 carrying the cleaned fiber thus to recontaminate the fiber with the dust which is very undesirable under some conditions. As will later be seen, at least one of the preferred embodiments of our invention not only removes the dust laden air from the cleaned fiber but does so with larger air volumes providing a dust rinsing action.

Swiftly moving, high volume air streams at the discharge of both saw gins and roller gins normally carry the cotton tufts and trash flowing in spaced apart relationship in the air streams and thus minimize the possibility of agglomeration at these points.

Prior art "saw type" lint cleaners in cotton gins and later textile mill processing remove these conveying air streams by "condensing" the trash and fibers on the slow moving surfaces of condenser drums until the fibers agglomerate into a batt or lap through which the conveying air passes causing the dust to collect in the batt, thus losing the opportunity to more efficiently and more gently separate the trash from the cotton fiber (lint).

SUMMARY OF THE INVENTION

The present invention has as its principle object the provision of a fiber cleaner (lint cleaner) that more efficiently removes the foreign matter (trash) from the fiber, and does so with less damage to the fiber. Another object of the present invention is to deliver the trash remaining in the fiber after processing in larger particle sizes and not as intimately imbedded in the fibers. Yet another object of the present invention is to provide apparatus and methods to reduce the fiber loss in the trash ejected from the fiber cleaner. Still another object of the invention is to provide methods and apparatus with greater operational reliability by eliminating certain steps in the methods and apparatus of current state of the art and other prior art methods and apparatus.

BRIEF DESCRIPTION OF THE DRAWINGS

Apparatus embodying features of our invention are depicted in the accompanying drawings following a drawing depicting present prior art apparatus wherein:

FIG. 1 is a cross-sectional, side elevation view of an embodiment of current prior art apparatus;

DESCRIPTION OF A PRIOR ART APPARATUS

Figure 2:
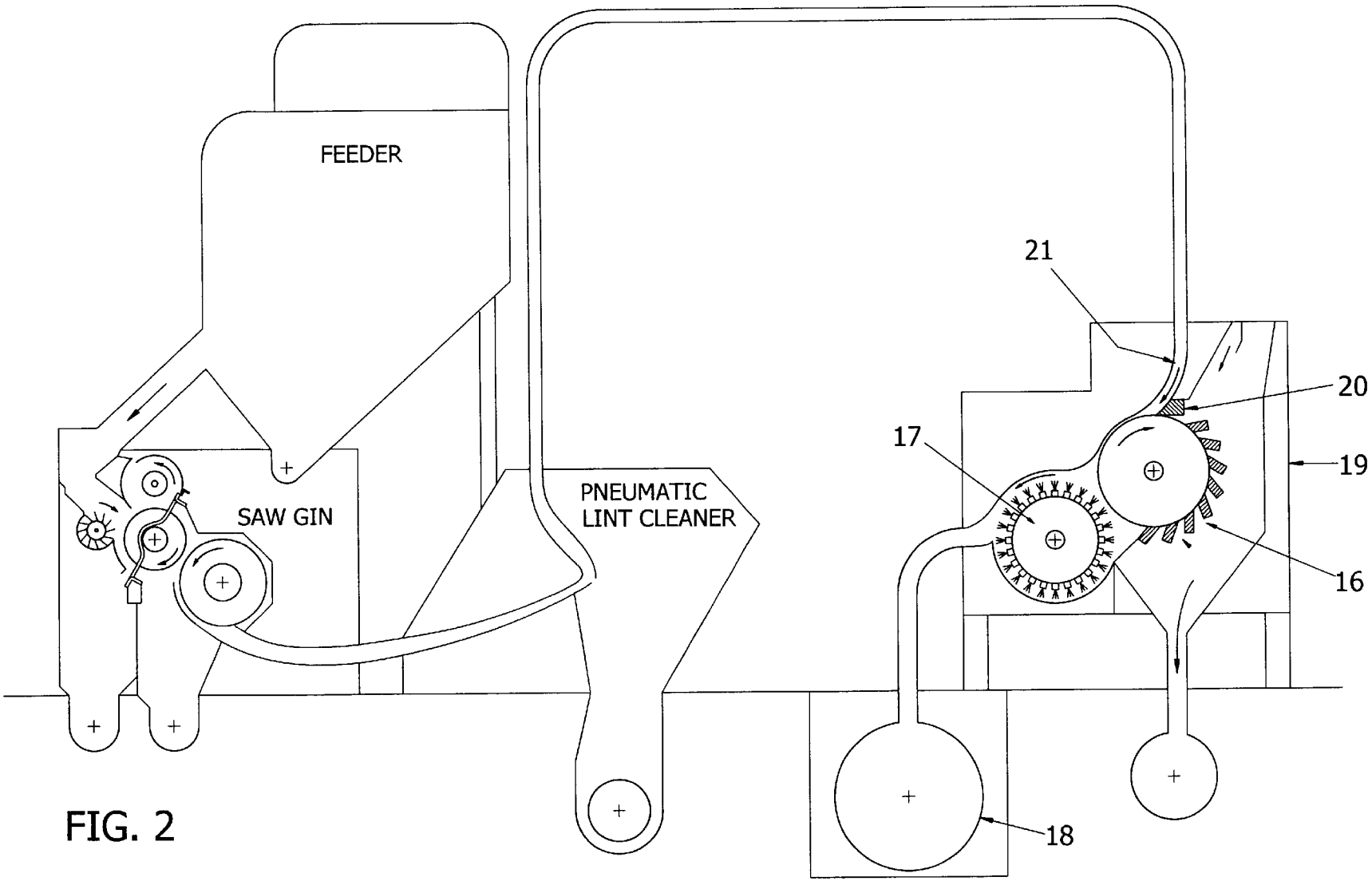
FIG. 2 is a cross-sectional, side elevation view of one form of apparatus embodying the primary elements of our invention.

Referring to the Figures for a clearer understanding of the invention, we first show in FIG. 1 a cross-sectional view of a typical current prior art apparatus in a system incorporating a feeder 1 feeding seed cotton to a saw gin 2 incorporating ginning saws 3 from which the ginned lint fiber is doffed by a doffing brush 4. Doffing brush 4 creates an air stream of approximately 800 cubic feet per minute per foot of machine width that propels the doffed lint tufts through duct work 5 which may deliver the lint and commingled trash through an optional pneumatic lint cleaner 6 in which some of the heavy trash particles are ejected. Duct work 7 conveys the lint and remaining trash commingled in an air stream to slow turning perforated condenser drum 8. At least some of the energy to cause air flow through duct 7 and through the perforations in condenser drum 8 is provided by fan 9 pulling air out either end of perforated drum 8. The relatively slowly turning drum 8 causes the cotton lint and commingled trash to build up on the surface of the drum sufficiently thick to form a cohesive batt that is pressed together and doffed from the drum by a pair of doffing rollers that are part of feed works 10. The batt is then fed down through additional feed works rollers onto the toothed surface of the much higher speed saw cylinder 11. Most commonly, feed works 10 also includes a stationary feed bar or plate to assist in intimately plucking the tufts of lint fibers apart to free the entrapped trash. The lint fibers are thus impaled on the surface of the toothed saw cylinder which carries fibers and trash over a series of grid bars 12 that have acute angle leading edges over which the lint is whipped, thus causing much of the trash and entangled fiber to be slung off by centrifugal force where it drops down into trash conveyor system 13, usually assisted by an air stream, that carries the trash referred to in the trade as motes to a collection system where the motes are baled for sale. As saw cylinder 11 continues to turn past the grid bars 12, it moves in close proximity to doffing brush 14 whose surface at the point of close proximity moves faster than the surface of the saw cylinder thus doffing the fibers from the saw cylinder. The fast turning doffing brush also develops an air current that delivers the cleaned lint to lint flue 15 that usually serves a plurality of systems just described located side by side. The lint flue then delivers the lint to a larger condenser that serves the plurality of ginning and lint cleaning systems. This larger condenser is referred to as the "battery condenser" in the trade. The exhaust from the battery condenser normally would have a fan mounted in the duct work that further assists the air stream conveying the lint from the individual lint cleaning systems just described to the surface of the revolving drum of the battery condenser.

DESCRIPTION OF PREFERRED EMBODIMENTS OF PRESENT INVENTION

FIG. 2 shows one embodiment of the present invention. In this embodiment, the conventional seed cotton feeder and gin stand are the same as in FIG. 1. Also, the optional pneumatic lint cleaner 6 may be used. After the pneumatic lint cleaner however, the conventional condenser 8 (FIG. 1) is eliminated and the air stream conveying the lint and the commingled trash moves directly into the lint cleaner 19. In this embodiment, a toothed surface of a clockwise rotating saw cylinder 16 is provided by a series of closely spaced apart discs with fang-type teeth on the periphery of the discs. The spacing of the discs axially creates a tooth density approximately the same as conventional lint cleaner saw cylinders, approximately ⅛ of an inch apart axially. This spacing also provides sufficient area for the desirable air flow at practical air velocities. Thus, the lint and trash from the gin stand is impaled on the teeth of the discs as the conveying air passes between the discs and supplies the air for the doffing brush 17. The doffing brush 17, in addition to doffing the fibers off the spaced apart disc cylinder 16, also develops some conveying energy to assist in propelling the fiber laden air stream from the lint cleaner housing 19 through the lint flue 18 and on to the battery condenser. In this form of our invention, the battery condenser must be equipped with a higher energy exhaust fan than is conventionally used as a single air stream conveys the lint from the gin stands through the lint cleaners and on to the battery condenser with only the assistance of the gin stand doffing brush and doffing brush 17 in the lint cleaner. Because of the need for the additional pneumatic conveying energy from the battery condenser dust flue fan, the entire housing 19 of this embodiment of our invention must be air-tight and operate under sub-atmospheric pressure. The single air stream from the gin stand through the battery condenser, however, considerably reduces the need for dust abatement equipment on the exhausts of the gin plant as all the fans 9 in FIG. 1 delivering exhaust air from the individual lint cleaner condensers are now eliminated.

Again referring to FIG. 2, another important element of our invention is the streamer plate 20. The leading edge of the lower surface of this streamer plate is located very close (within 4 millimeters) to the tips of the teeth of the spaced apart saws making up cylinder 16. This lower surface of the streamer plate meets its upper surface in an acute angle forming a leading edge with a small radius. The upper surface of the streamer plate may form a concave arc which may be the continuation of the curvature of the duct work entering the lint cleaner at 21. The body of this streamer plate 20 may be extended away from the leading edge, increasing in depth to provide rigidity commensurate with the axial length of toothed cylinder 16. The action, then, of this streamer plate 20 is to firmly apply the fibers onto the tips of the saw teeth and in so doing, strip back commingled trash particles. This action is different from the conventional lint cleaners in which a feed roller and feed plate firmly grip a batt of considerable mass of fibers and trash while the fanged teeth of the saw cylinder plow through the mass of fibers only a fraction of a centimeter away from where the fibers are being held between the feed plate and the feed roller. In our invention, the tufts of fibers individually pass under the streamer plate, and only the momentum of the fibers themselves whipping over the acute angle leading edge of the streamer plate offer any resistance to the fang-type teeth of the saw cylinder 16.

Figure 3:
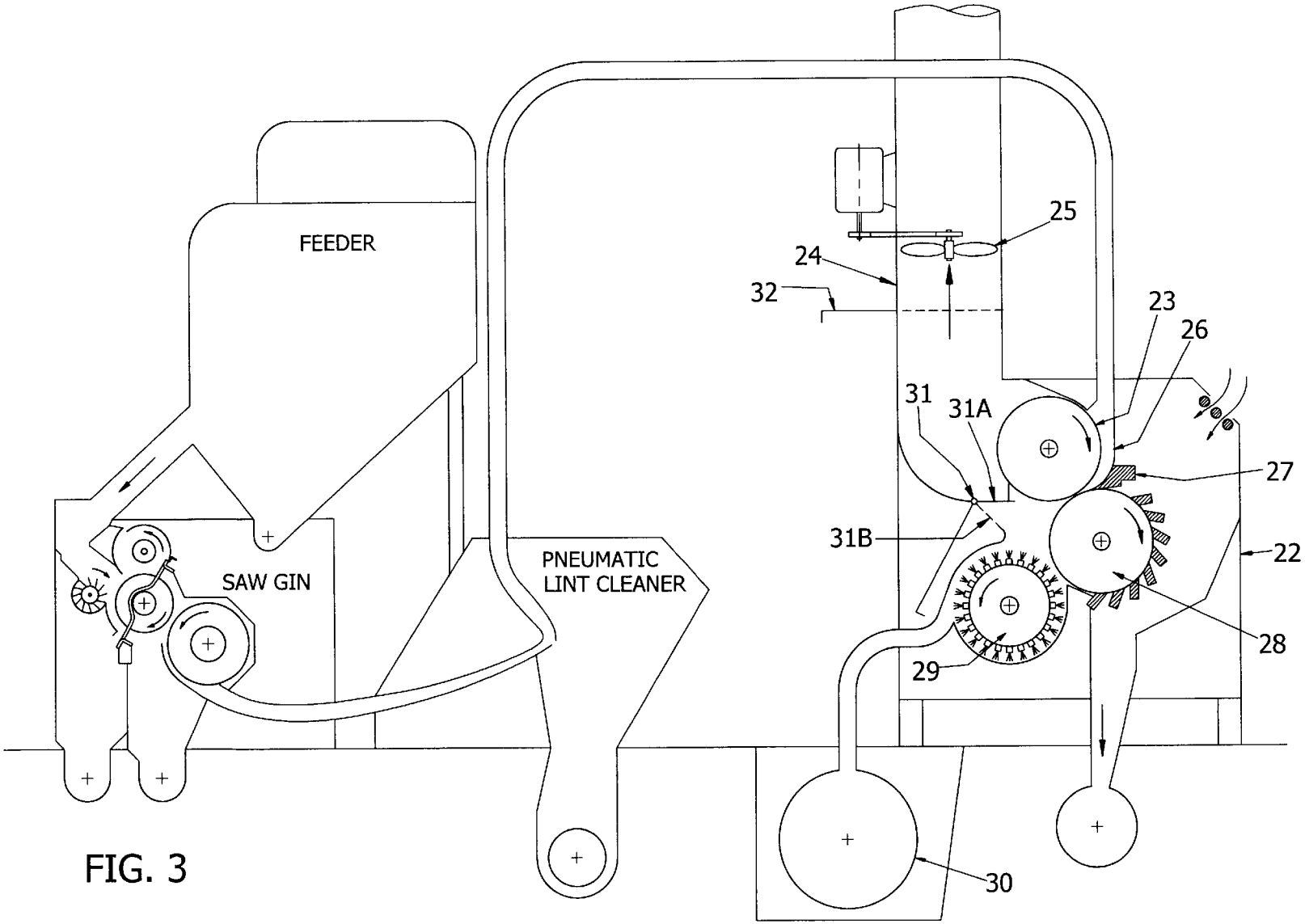
FIG. 3 is a cross-sectional, side elevation view of another form of our invention embodying the main elements of our invention.
Figure 3:
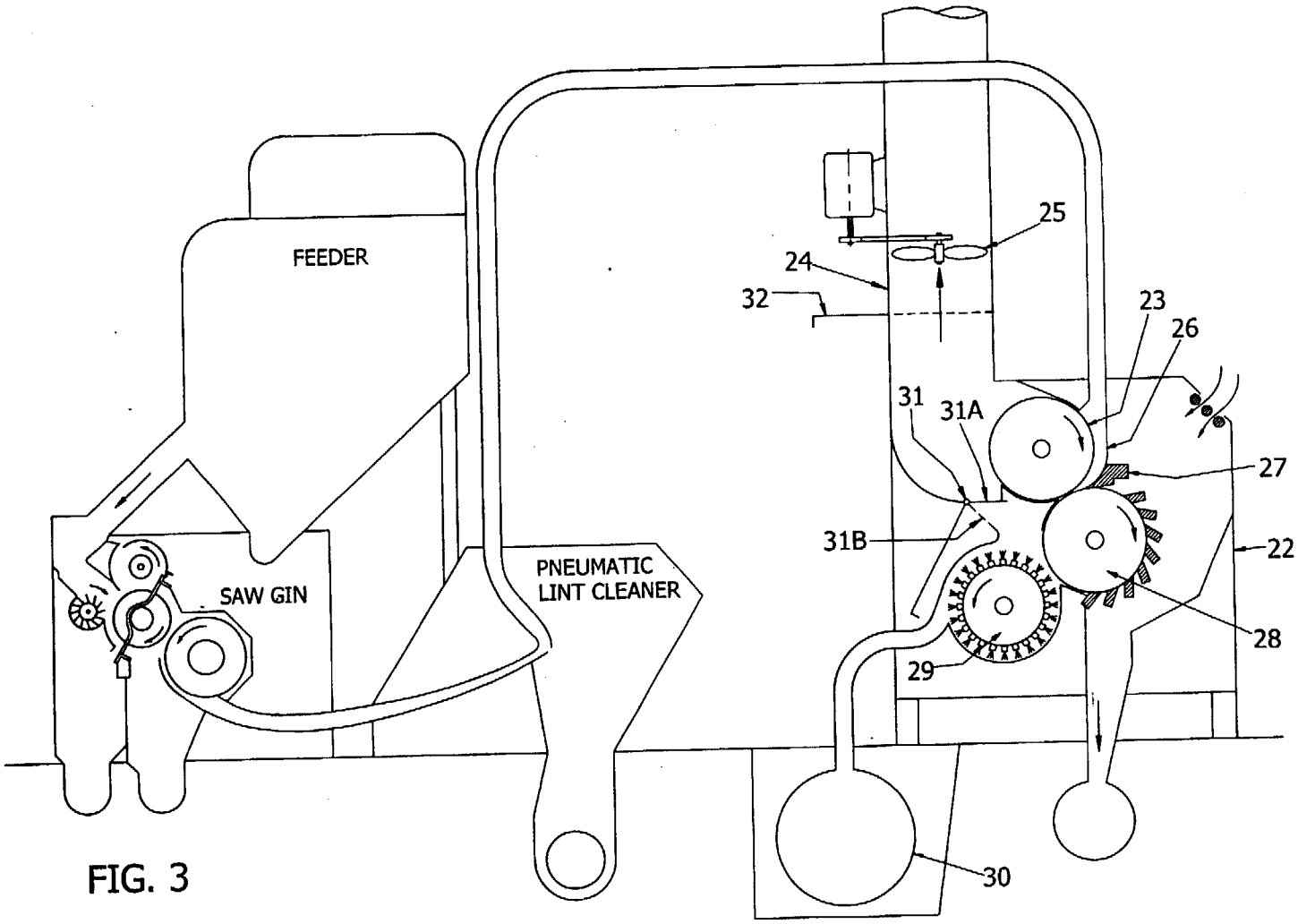

FIG. 3 shows another embodiment of our invention. In this embodiment as in current prior art practice (FIG. 1) and the first embodiment using the principle elements of our invention, FIG. 2, the fiber and commingled trash flow in a fast moving, high volume air stream, approximately 800 cubic feet of air per minute per foot of machine width, from a cotton gin stand or other apparatus that may deliver fibers floating in an air stream commingled with foreign matter from which it is to be separated. As in FIG. 1 and FIG. 2, the air stream optionally may pass through a pneumatic separator and continue at air velocities and volumes sufficient for conveying which minimize the tendency to agglomerate in the duct work. As the air stream in the duct work approaches this second embodiment of our invention 22 (as shown in FIG. 3) it tangentially approaches the perforated surface of a high speed revolving cylinder 23. The surface speed of this cylinder preferably moves as fast or faster than the air stream, thus, minimizing the likelihood of the individual tufts of fibers and commingled trash coming in contact with each other if they should lay on the surface of the perforated metal cylinder. The air stream conveying the commingled fiber and foreign matter to the cleaner 22 is drawn through the perforated surface of cylinder 23 and exhausts out duct 24 responding to the pull fan 25 that exhausts this air from the system. The perforations on the surface of cylinder 23 are sized and spaced to allow adequate air flow there through and to prevent the desirable fibers from passing through the perforations with the air. However, it is often desirable to remove fine dust and small particles of foreign matter and even short fibers from the longer fibers, and the perforations in cylinder 23 may be sized to optimize this foreign matter removal.

The clockwise rotation of cylinder 23 in FIG. 3 urges the commingled fibers and trash down to the point of very close proximity (preferably less than 2 millimeters) to the toothed surface of cylinder 28 at which the clockwise rotation of cylinder 28 cleanly plucks the fibrous material from the remaining air stream or the surface of the perforated cylinder 23. In this embodiment, toothed cylinder 28 is substantially a solid cylinder with short fang-type teeth covering its surface. The surface speed of the toothed cylinder 28 preferably is faster than the surface speed of the perforated cylinder 23, thus again, the individual fiber tufts and commingled trash are not allowed to agglomerate. The duct work 26 adjacent the cylinder 23 preferably gently curves smoothly coming ever closer to the surface of the clockwise rotating cylinder 23 to maintain air flow velocity as the air is partially flowing through the perforations in cylinder 23. The curved duct surface 26 terminates smoothly against the upper surface of streamer bar 27 which is similar to the streamer bar 20 that was described in reference to our embodiment shown in FIG. 2.

As the fiber tufts and commingled trash are laid on the fang-type teeth on cylinder 28 (FIG. 3) by cylinder 23 and the remaining air stream, the teeth on cylinder 28 cause a sudden reversal of direction of the fiber and trash and whip them individually over the sharp acute angle front edge of streamer bar 27 as in the FIG. 2 embodiment, item 20. As toothed cylinder 28 continues to rotate clockwise (FIG. 3), it whips the fibers over a series of grid bars as is conventional in the prior art, but because the tufts of fiber are individually processed through the system without being formed into a batt or a lap, the separating action of the trash from the fibers is more efficient and the fiber breakage and trash shattering are less than in prior art devices. As toothed cylinder 28 rotates clockwise carrying the fiber past the grid bars the fiber approaches doffing brush cylinder 29 which delivers the cleaned fibrous material (lint) to lint flue 30 which delivers the lint normally from two or more systems just described as in FIG. 3, to a battery condenser with a pull fan on its exhaust. Doffing brush 29 inhales clean air from the atmosphere and provides part of the energy to propel the lint to the battery condenser with the pull fan on the discharge of the battery condenser providing the remainder of the energy to pneumatically convey the fiber (lint) to the battery condenser similar to prior art.

The operation of the embodiment of our invention shown in FIG. 3 just described is with valve 31 in position 31A and valve 32 opened as shown in the drawing. Under some conditions it is desirable to operate this embodiment with valve 32 closed and fan 25 de-energized with valve 31 in the 31B position. With the valves thus set and fan 25 de-energized, the conveying air coming from the gin stand brush cylinder and passing through the perforations of cylinder 23 would now be directed to supply the required air to doffing brush 29 which with the aid of the dust flue fan in the battery condenser following flue 30 would convey the fiber pneumatically to the battery condenser. The dust flue fan in the battery condenser under these conditions would need to provide more pneumatic conveying energy than when fan 25 is energized, valve 32 is open and valve 31 is in the 31A position because there would be only a single air stream flowing from the gin stand through the lint cleaners and on through the battery condenser much the same as described in our embodiment shown in FIG. 2.

While we have shown our invention in various forms, it will be obvious to those skilled in the art that it is not so limited but is susceptible of various changes and modifications without departing from the spirit thereof.

What we claim is:

1. In a fiber cleaning apparatus in which fiber tufts are pneumatically conveyed into the apparatus in a high speed air stream commingled with foreign matter, an improvement comprising:

(a) a revolving cleaning cylinder with teeth on the periphery of said revolving cleaning cylinder capable of holding the fiber tufts on said teeth;

(b) an air duct surrounding the air stream and controlling the fiber tufts commingled with the foreign matter, said air duct terminating adjacent the surface of said revolving cleaning cylinder to deliver the fiber tufts directly to said teeth of said revolving cleaning cylinder, the air stream engaging said revolving cleaning cylinder at conveying velocities and fiber-to-air mass ratios sufficient to prevent agglomeration of the individual fiber tufts being pneumatically conveyed therein;

(c) separating means located at the terminal of said air duct at the surface of said revolving cleaning cylinder to substantially completely separate the conveying air from the desirable fiber tufts as the desirable fiber tufts are substantially completely delivered onto said teeth of said revolving cleaning cylinder without allowing the individual fiber tufts to agglomerate; and (d) means adjacent the periphery of said revolving cleaning cylinder to cause the foreign matter to be separated from the fiber tufts.

2. The improvement as defined in claim 1, wherein said separating means to separate the conveying air from the desirable fiber tufts comprises a construction of said revolving cleaning cylinder wherein the air may pass between said teeth and flow through said revolving cleaning cylinder to a point in its rotation where the air may be exhausted from said revolving cleaning cylinder.

3. The improvement as defined in claim 2, wherein said construction of said revolving cleaning cylinder comprises spaced apart discs with teeth attached to the periphery of said discs, said discs mounted on a common shaft spaced apart axially sufficiently to allow free air flow there between while preventing desirable fiber tufts from flowing past said teeth.

4. The improvement as defined in claim 1 in which said means adjacent the periphery of said revolving cleaning cylinder to cause said foreign matter to separate from the fiber tufts comprises a fixed streamer plate whose leading edge faces against the direction of rotation of said revolving cleaning cylinder and having a lower surface approximately tangent to and in close proximity to the upper surface of said revolving cleaning cylinder at said leading edge and having an upper surface joining said lower surface in an acute angle to comb back and impale said fiber firmly onto said teeth of the revolving cleaning cylinder.

5. The improvement as defined in claim 4 in which said means adjacent the periphery of said revolving cleaning cylinder to cause foreign matter to separate from the fiber tufts comprises a fixed bar adjacently following said streamer plate in the direction of rotation of said revolving cleaning cylinder with an acute angle leading edge facing against the rotation of said revolving cleaning cylinder and in close proximity to the periphery thereof to cause the free ends of the fiber tufts to whip over said acute angle leading edge to throw off the foreign matter as the fiber tuft surfaces adjacent said revolving cleaning cylinder are impaled on said teeth.

6. The improvement as defined in claim 1 in which said means adjacent the periphery of said revolving cleaning cylinder to cause foreign matter to separate from the fiber tufts comprises a fixed bar with an acute angle leading edge facing against the rotation of said revolving cleaning cylinder and in close proximity to the periphery thereof to cause the free ends of the fiber tufts to whip over said acute angle leading edge to throw off the foreign matter as the fiber tuft surfaces adjacent said revolving cleaning cylinder are impaled on said teeth.

7. The improvement as defined in claim 1 in which said air stream that conveys the fiber tufts also pneumatically conveys the fiber tufts from said revolving cleaning cylinder.

8. The improvement as defined in claim 1 in which the surface of said revolving cleaning cylinder with said teeth moves at a velocity greater than the velocity of said air stream pneumatically conveying the fiber tufts.

9. The improvement as defined in claim 1 wherein said separating means to separate the conveying air from the desirable fiber tufts comprises a perforated cylinder that allows air flow there through, but is resistant to desirable fiber tufts penetration inwardly of its periphery which rotates proximate to the surface of said revolving cleaning cylinder with teeth, said close proximity sufficient to assure that said teeth carry substantially all of the desirable fiber tufts away from the point of closest proximity of said perforated cylinder and said revolving cleaning cylinder.

10. The improvement as defined in claim 9 wherein said perforated cylinder rotates in the same angular direction as said revolving cleaning cylinder with teeth at a surface speed that prevents agglomeration of individual fiber masses that may contact the perforated cylinder.

11. The improvement as defined in claim 9 wherein said perforated cylinder has a cylindrical outer shell with openings sufficiently large to allow air passage there-through but small enough to prevent desirable fiber tufts from passing there-through.

12. The improvement as defined in claim 9 in which said perforated cylinder comprises a plurality of discs mounted on a common shaft and spaced apart axially sufficiently to allow air to pass between adjacent discs while preventing the desirable fiber tufts from passing there-between.

13. The improvement as defined in claim 9 wherein said air duct is substantially air tight to form a substantially air tight zone that is under sub-atmospheric pressure necessary to maintain the air velocities and air volumes needed to prevent the agglomeration of said fiber tufts, wherein:

a first side of said air duct entering said apparatus joins tightly against a substantially air tight housing substantially surrounding said perforated cylinder, said air duct additionally including an air outlet leading to an exhaust fan;

said air tight housing substantially surrounding said perforated cylinder terminates substantially proximate to said teeth on said cleaning cylinder;

said cleaning cylinder including a solid cylinder on which teeth are mounted to minimize air flow therethrough; and wherein a second side of said air duct entering said apparatus terminates substantially proximate to said teeth on said cleaning cylinder opposite the point of closest proximity between said cleaning cylinder and said perforated cylinder.

14. The improvement as defined in claim 1 further including a substantially air tight housing around said elements, said substantially airtight housing including:

an opening for said high speed air stream to enter said housing;

an opening for the air stream carrying the cleaned fiber to exit the housing and means to allow the removal of said foreign matter from said housing without altering the sub-atmospheric pressure within said housing necessary to maintain the air velocities and air volumes needed to prevent the agglomeration of said fiber tufts.

15. The improvement as defined in claim 14 in which said means to allow said foreign matter to be removed from said housing includes an air stream flowing from a trash gathering hopper on said lower side of said housing combined with an adjustable air inlet opening on the upper side of said housing to bleed air into said housing to balance said air stream flowing from said trash gathering hopper.

16. The improvement as defined in claim 1 further comprising a doffing cylinder;

wherein said separating means comprises a perforated cylinder for airflow therethrough;

said separating means substantially blocking the inward penetration of the desirable fiber tufts;

said separating means rotating proximate to the periphery of said doffing cylinder, the periphery of said doffing cylinder rotating proximate to the surfaces of said cleaning cylinder and said perforated cylinder;

said doffing cylinder and said cleaning cylinder rotating in the same angular direction, with said doffing cylinder being sufficiently close to said perforated cylinder and said cleaning cylinder such that substantially all of the desirable fiber tufts are transferred to said teeth of said cleaning cylinder.

* * * * *

UNITED STATES PATENT AND TRADEMARK OFFICE

CERTIFICATE OF CORRECTION

PATENT NO. : 6,088,881
DATED : July 18, 2000
INVENTOR(S) : Van Dorn et al.

It is certified that error appears in the above-identified patent and that said Letters Patent is hereby corrected as shown below:

The Title page showing an illustrative figure should be deleted, and substitute therefor the attached Title page.

The drawing sheet consisting of figure 3 should be deleted, and substitute therefore the attached drawing sheet 3 of 3.

Signed and Sealed this

Eighteenth Day of December, 2001

*Attest:*

*Attesting Officer*

JAMES E. ROGAN
*Director of the United States Patent and Trademark Office*

United States Patent [19]

Van Doorn et al.

[11] Patent Number: 6,088,881

[45] Date of Patent: Jul. 18, 2000

[54] METHOD AND APPARATUS FOR SEPARATING FOREIGN MATTER FROM FIBROUS MATERIAL

[75] Inventors: Donald William Van Doorn, Columbus; James Brown Hawkins, Fortson, both of Ga.

[73] Assignee: Lummus Corporation, Columbus, Ga.

[21] Appl. No.: 09/162,563

[22] Filed: Sep. 29, 1998

[51] Int. Cl.[7] ..... D01B 1/04

[52] U.S. Cl. ..... 19/202; 19/39; 19/64.5

[58] Field of Search ..... 19/40, 41, 65 A, 19/200, 202, 203, 204, 205, 39, 42, 48 R, 64.5

[56] References Cited

U.S. PATENT DOCUMENTS

| | | | |
|---|---|---|---|
| Re. 26,649 | 8/1969 | Reddick . | |
| 2,948,022 | 8/1960 | Day | 19/203 |
| 3,470,588 | 10/1969 | Just | 19/202 |
| 4,407,047 | 10/1983 | Van Doorn et al. | 19/202 |
| 4,458,381 | 7/1984 | Van Doorn et al. | 19/202 |
| 5,173,994 | 12/1992 | Gillum et al. | 19/200 |
| 5,295,283 | 3/1994 | Gillum et al. | 19/200 |

*Primary Examiner*—Michael A. Neas
*Assistant Examiner*—Gary L. Welch
*Attorney, Agent, or Firm*—Robert J. Veal; Veal & Asociates, LLC

[57] ABSTRACT

An apparatus for separating foreign matter from fiber tufts includes an air duct in which fiber tufts are pneumatically conveyed into the system via a high speed air stream. The air duct provides an air stream that conveys the fiber tufts with trash on to a revolving cleaning cylinder having teeth to engage the fiber tufts at a velocity that is sufficient to prevent agglomeration of the fiber tufts on a cylinder. The fiber tufts and trash thereby engage a separating means without agglomeration of the fiber tufts. The fiber tufts and trash further engage a streamer plate and grid bars to separate the trash from the fiber tufts such that the clean fiber tufts are distributed to a lint flue. The apparatus may further include a perforated cylinder in close proximity with the revolving cleaning cylinder that allows air to flow there-through, but that prevents penetration of the perforated cylinder surface by the desired fiber tufts. The use of the perforated cylinder provides an efficient means to cause the fiber tufts to engage the revolving cleaning cylinder without agglomeration to remove the undesired trash and deliver the desirable fiber tufts into a battery condenser.

16 Claims, 3 Drawing Sheets

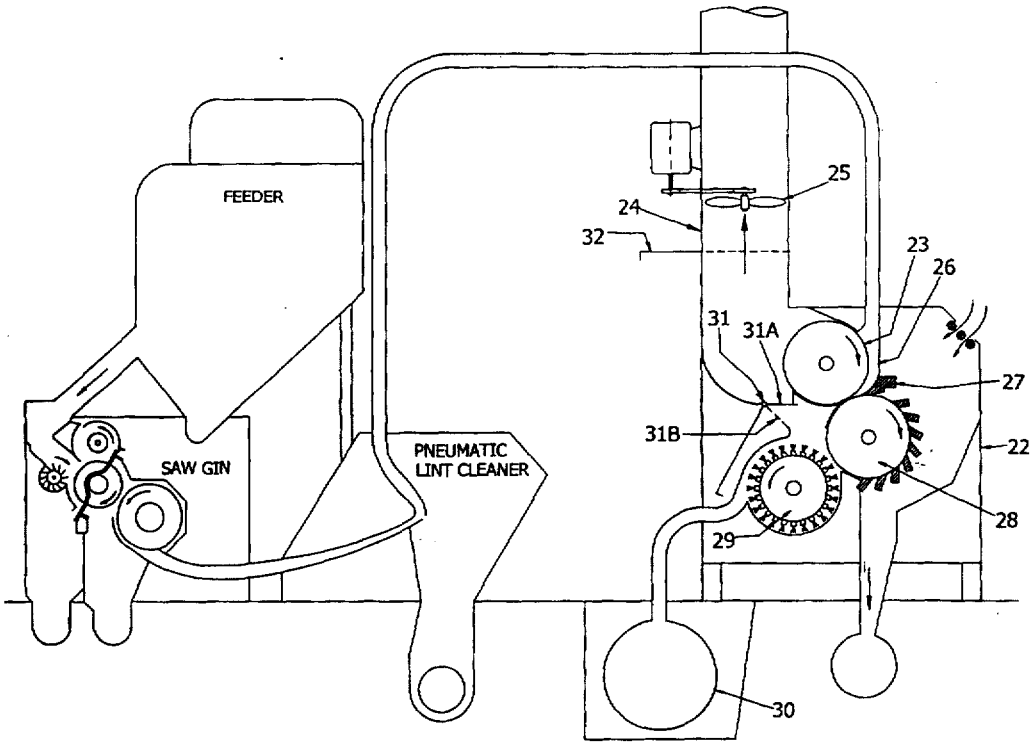

US006088881C1

(12) EX PARTE REEXAMINATION CERTIFICATE (6226th)

United States Patent
Van Doorn et al.

(10) Number: US 6,088,881 C1
(45) Certificate Issued: May 13, 2008

(54) METHOD AND APPARATUS FOR SEPARATING FOREIGN MATTER FROM FIBROUS MATERIAL

(75) Inventors: Donald William Van Doorn, Columbus, GA (US); James Brown Hawkins, Fortson, GA (US)

(73) Assignee: Lummus Corporation, Columbus, GA (US)

Reexamination Request:
No. 90/008,200, Sep. 1, 2006

Reexamination Certificate for:

| | |
|---|---|
| Patent No.: | **6,088,881** |
| Issued: | **Jul. 18, 2000** |
| Appl. No.: | **09/162,563** |
| Filed: | **Sep. 29, 1998** |

Certificate of Correction issued Dec. 18, 2001.

(51) Int. Cl.
*D01B 3/00* (2006.01)
*D01B 1/04* (2006.01)

(52) U.S. Cl. ..... 19/202; 19/39; 19/64.5
(58) Field of Classification Search ..... None
See application file for complete search history.

(56) References Cited

PUBLICATIONS

U.S. Department of Agriculture, Circular No. 858: The Flow Through Lint–Cotton cleaner, Nov. 1950, U.S. Government Printing Office, Washington, D.C.

*Primary Examiner*—Aaron J. Lewis

(57) ABSTRACT

An apparatus for separating foreign matter fiber tufts includes an air duct in which fiber tufts are pneumatically conveyed into the system via a high speed air stream. The air duct provides an air stream that conveys the fiber tufts with trash on a revolving cleaning cylinder having teeth to engage the fiber tufts at a velocity that is sufficient to prevent agglomeration of the fiber tufts on a cylinder. The fiber tufts and trash thereby engage a separating means without agglomeration of the fiber tufts. The fiber tufts and trash further engage a streamer plate and grid bars to separate the trash from the fiber tufts such that the clean fiber tufts are distributed to a lint flue. The apparatus may further include a perforated cylinder in close proximity with the revolving cleaning cylinder that allows air to flow there-through, but that prevents penetration of the perforated cylinder surface by the desired fiber tufts. The use of the perforated cylinder provides an efficient means to cause the fiber tufts to engage the revolving cleaning cylinder without agglomeration to remove the undesired trash and deliver the desirable fiber tufts into a battery condenser.

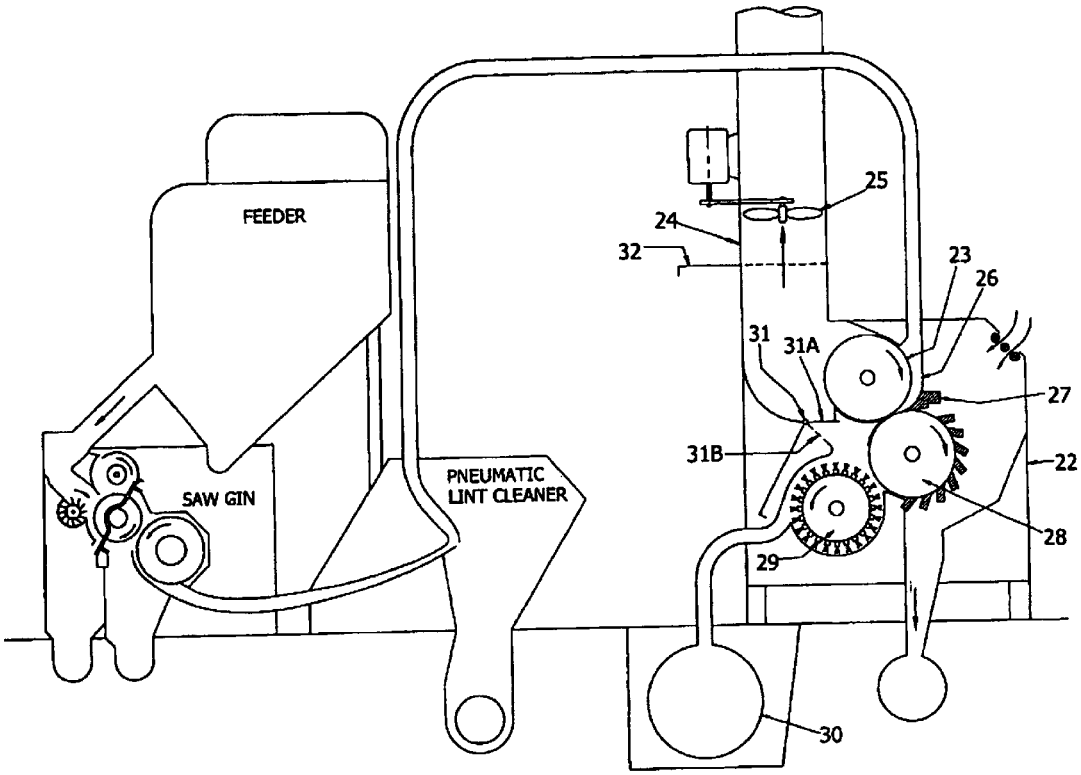

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–16 is confirmed.

* * * * *